US005568945A

United States Patent [19]

Hunt

[11] Patent Number: 5,568,945

[45] Date of Patent: Oct. 29, 1996

[54] STABILIZING BRACKET FOR ADJUSTABLE METER SETTER

[76] Inventor: Mitchell Hunt, 1165 Park Ave., Murfreesboro, Tenn. 37130

[21] Appl. No.: 517,602

[22] Filed: Aug. 22, 1995

[51] Int. Cl.[6] ..... F16L 35/00

[52] U.S. Cl. ..... 285/30; 285/137.1

[58] Field of Search ..... 285/30, 137.1, 285/136, 133.1

[56] References Cited

U.S. PATENT DOCUMENTS

| | | | |
|---|---|---|---|
| 1,290,665 | 1/1919 | Russell | 285/30 |
| 1,346,440 | 7/1920 | Bradfield | 285/30 |
| 1,835,924 | 12/1931 | Bartholomay | 285/30 |
| 2,690,077 | 9/1954 | Lisenbee | 285/30 X |
| 5,145,214 | 9/1992 | Hunt | 285/30 |

*Primary Examiner*—Dave W. Arola
*Attorney, Agent, or Firm*—Parmelee, Bollinger & Bramblett

[57] ABSTRACT

A stabilizing bracket for an adjustable water meter setter is cruciform in shape to fit within a subterranean housing enclosing the setter and meter. The two arms are mutually orthogonal and extend to near the housing sidewall. One of the arms has openings through which pass the two vertical water pipes. The two arms are foldable to make the bracket more compact to facilitate delivery to the installation site.

7 Claims, 1 Drawing Sheet

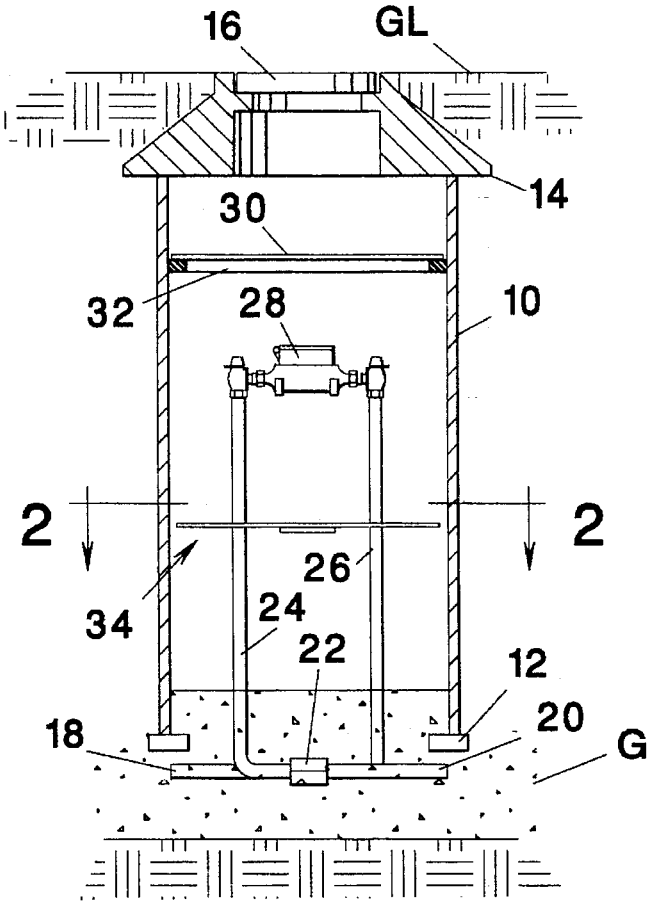
FIG. 1
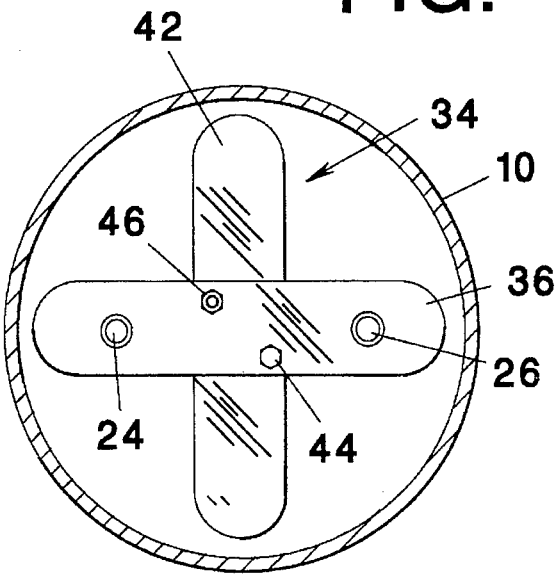
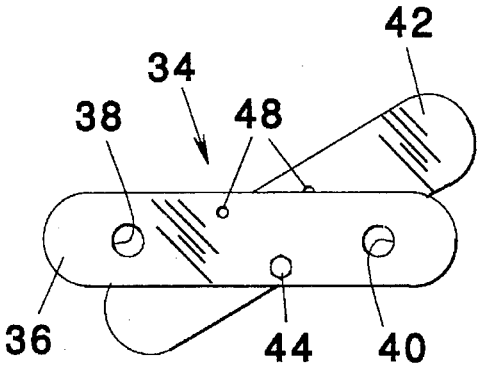
FIG. 3
FIG. 2

STABILIZING BRACKET FOR ADJUSTABLE METER SETTER

TECHNICAL FIELD

This invention relates to a bracket for stabilizing an adjustable meter setter. More particularly, it relates to such a bracket stabilizing a meter setter mounted within a subterranean housing.

BACKGROUND ART

In my U.S. Pat. 5,145,214 there is disclosed an adjustable meter setter which can easily accept water meters of different sizes. It is in the form of a pair of L-shaped pipes which are positioned in reversed relationship with their horizontal legs parallel with one another in side by side relationship. One of the horizontal legs is connected to a water supply line. The other horizontal leg is connected to a water distribution line. The vertical legs of the pipes extend upwardly and are threaded to engage the end fittings of a water meter. Clamps are provided which engage the horizontal legs of the pipes to form a rigid but adjustable support for a water meter.

One common way of employing such an apparatus is to house it in a subterranean housing. Commonly, such a housing is a cylinder which may be made of any suitable material such as, for example, plastic or concrete. The top of the cylinder is at ground level. The meter, which may be of the remote reading type, might be as much as two feet below ground level and the vertical portions of the water pipes might be on the order of, for example, three feet in length. In such an installation it is important to stabilize the vertical pipes so as to maintain the meter in alignment with the ground level opening and to prevent "frost jump". The latter occurs when the meter is so near the side of the housing that it freezes. Normally the warmer subterranean air prevents this from happening. It is also important to retain the ability of this warmer air to circulate within the housing.

Accordingly, it is a primary object of the present invention to provide a bracket for stabilizing and centering the meter and vertical pipes within the housing. Another object is to provide such a bracket which is open so as not to block natural circulation of air within the housing. Still another object is to provide such a bracket which is collapsible to reduce its size and facilitate its delivery to a work site. The manner in which these objects are achieved will be apparent from the following description and appended claims.

DISCLOSURE OF THE INVENTION

The invention comprises a bracket of cruciform configuration having a pair of arms whose ends touch, or closely approach, the sides of the subterranean housing. One of the arms includes a pair of openings which receive the vertical portions of the water pipes therethrough. The arms are connected together by means of a pivot member which permits them to fold when not in use and a locking member which keeps them properly deployed when installed.

BRIEF DESCRIPTION OF THE DRAWINGS

FIG. 1 is a cross-sectional elevation of a water meter installation incorporating the present invention;

FIG. 2 is an enlarged cross-section taken substantially along the line 2—2 of FIG. 1; and FIG. 3 is an illustration of the bracket of FIG. 2 partially folded.

BEST MODE FOR CARRYING OUT THE INVENTION

FIG. 1 illustrates a cylindrical housing 10 buried in the earth below ground level GL. It rests upon a ring of bricks forming a base 12. Its top is closed by a metal ring 14 and a removable cover 16. The meter setter comprises a pair of L-shaped pipes whose horizontal portions 18, 20 are interconnected by a clamp 22 and lie within a bed of gravel G. The vertical portions 24, 26 extend upwardly within the housing 10 and are connected to the inlet and discharge ports of a water meter 28. An inner insulation lid 30 is positioned between the water meter 28 and the top of the housing 10 on a support ring 32.

The bracket 34 of this invention is mounted within the housing 10 below the meter 28. The construction of the bracket 34 is best illustrated in FIG. 2. It comprises a first member in the form of a substantially planar elongated bar 36 which, when installed, extends diametrically across the housing 10. The bar 36 includes a pair of spaced openings 38, 40 (FIG. 3). During installation the bar 36 is slid over the vertical pipe portions 24, 26 which are retained within the openings 38, 40. This is done before the meter 28 is installed.

Extending orthogonally from the bar 36 is a second member in the form of a substantially planar elongated bar 42. The bar 42 is essentially similar to the first member bar 36, but need not include the openings 38, 40. The first and second members are maintained in their cruciform configuration by means of a pivot member 44 and a locking member 46.

The pivot member 44 would normally be factory installed and could be any type of pivot pin which extends through pivot holes (not shown) in the two bracket members. As illustrated in the drawings, the pivot member 44 is a bolt and nut. The locking member 46 is also a nut and bolt which is installed upon installation by inserting the bolt through locking holes 48 (FIG. 3) in the members. As will be seen in FIG. 3 removal of the locking member 46 permits the two bars to be swiveled into alignment to reduce the size of the bracket and facilitate its delivery to an installation site. Various means may be employed for vertically positioning the bracket 34 within the housing 10, including simple friction of the openings 38, 40 against the vertical pipe portions 24, 26. Another simple technique would be to apply a solder bead to the outside of one or both of the vertical pipe portions 24, 26 upon which the bar 36 may rest.

It will, of course be apparent that the stabilizing bracket of this invention may take various forms and, in particular, may be adapted for use in a housing which is other than cylindrical. It will also be apparent that a number of other variations and modifications may be made in this invention without departing from its spirit and scope. Accordingly the foregoing description is to be construed as illustrative only, rather than limiting. This invention is limited only by the scope of the following claims.

I claim:

1. In a water meter of the type including first and second spaced, substantially parallel, vertical water pipes connected, respectively, to the input and discharge ports of a water meter and housed within a vertically extending subterranean housing having at least one sidewall spaced from said first and second pipes, the improvement comprising:

first member enclosing said first and second pipes and extending outwardly therefrom upward radially spaced first portions of the sidewalls of said housing; and a second member operatively interconnected with said first member and said first and second pipes and extending outwardly therefrom toward radially spaced second portions of said sidewalls, said first and second portions being circumstantially spaced from one another.

2. The improvement of claim 1 wherein said first member is a substantially planar elongated bar defining first and second spaced openings enclosing said first and second pipes.

3. The improvement of claim 2 wherein said second member is a substantially planar elongated bar secured to said first member intermediate said first and second openings and extending substantially orthogonally therefrom.

4. The improvement of claim 3 wherein said first and second members are secured to one another by first and second spaced linking members extending therethrough.

5. The improvement of claim 4 wherein at least one of said linking members is removable and the other serves as a pivot to permit folding of said first and second members when removed from said installation.

6. A stabilizing bracket for use within a water meter installation of the type including first and second water pipes housed within a vertical subterranean housing having at least one sidewall which comprises:

a first substantially planar elongated member defining first and second openings positioned receive said first and second pipes, respectively, therethrough;

a second substantially planar elongated member;

pivot means interconnecting said first and second members intermediate said first and second openings; and releasable locking means fbr retaining said first and second members in substantially orthogonal relationship.

7. The bracket of claim 6 wherein said locking means is bolt.

* * * * *

UNITED STATES PATENT AND TRADEMARK OFFICE

CERTIFICATE OF CORRECTION

PATENT NO. : 5,568,945

DATED : Oct. 29, 1996

INVENTOR(S) : Mitchell Hunt

It is certified that error appears in the above-identified patent and that said Letters Patent is hereby corrected as shown below:

Col. 2, line 64: delete "upward" and substitute therefor -- toward --;

Col. 4, line 6: between "positioned" and "receive" insert -- to --; and

Col. 4, line 11: delete "fbr" and substitute therefor -- for --.

Signed and Sealed this

Fourteenth Day of January, 1997

Bruce Lehman

*Attest:*

BRUCE LEHMAN

*Attesting Officer*

*Commissioner of Patents and Trademarks*